US010038261B2

(12) United States Patent
Hashimoto

(10) Patent No.: US 10,038,261 B2
(45) Date of Patent: Jul. 31, 2018

(54) CONNECTOR ASSEMBLY AND ELECTRICAL CONNECTOR

(71) Applicant: DAI-ICHI SEIKO CO., LTD., Kyoto (JP)

(72) Inventor: Yoichi Hashimoto, Machida (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 0 days.

(21) Appl. No.: 15/602,782

(22) Filed: May 23, 2017

(65) Prior Publication Data

US 2017/0346209 A1 Nov. 30, 2017

(30) Foreign Application Priority Data

May 25, 2016 (JP) ..... 2016-103967

(51) Int. Cl.
*H01R 9/05* (2006.01)
*H01R 12/75* (2011.01)
(Continued)

(52) U.S. Cl.
CPC ..... *H01R 12/75* (2013.01); *H01R 9/0515* (2013.01); *H01R 13/447* (2013.01);
(Continued)

(58) Field of Classification Search
CPC .... H01R 2103/00; H01R 9/0518; H01R 9/05; H01R 9/053; H01R 24/40; H01R 24/50; H01R 24/053; H01R 13/658
(Continued)

(56) References Cited

U.S. PATENT DOCUMENTS 7,762,841 B2 * 7/2010 Ho ..... H01R 9/0518 439/582
7,938,681 B2 * 5/2011 Lee ..... H01R 13/112 439/582
(Continued)

FOREIGN PATENT DOCUMENTS

CN 101834391 A 9/2010
CN 201898214 U 7/2011
(Continued)

OTHER PUBLICATIONS

JP Office Action dated Jan. 30, 2018, from corresponding JP Appl No. P2016-103967, 4 pp.
(Continued)

*Primary Examiner* — Hien Vu
(74) *Attorney, Agent, or Firm* — Studebaker & Brackett PC

(57) ABSTRACT

A plug connector includes a signal contact conductor to which an internal conductor of a coaxial cable is connected, a ground contact conductor to which an external conductor of the coaxial cable is connected, and an insulating housing that insulates the signal contact conductor from the ground contact conductor. The insulating housing includes an insulating main body in which the signal contact conductor is held and a protrusion that protrudes from a peripheral surface of the insulating main body in a radially outward direction of the insulating main body. The protrusion includes a base portion on which an insulator and the external conductor of the coaxial cable are placed and a pair of walls that are erected on the base portion and are disposed to interpose at least a tip of the external conductor therebetween.

10 Claims, 12 Drawing Sheets

(51) Int. Cl.

| | |
|---|---|
| ***H01R 13/447*** | (2006.01) |
| ***H01R 13/50*** | (2006.01) |
| ***H01R 24/40*** | (2011.01) |
| *H01R 4/18* | (2006.01) |
| *H01R 13/502* | (2006.01) |
| *H01R 13/58* | (2006.01) |

(52) U.S. Cl.
CPC ..... *H01R 13/501* (2013.01); *H01R 24/40* (2013.01); *H01R 4/185* (2013.01); *H01R 13/502* (2013.01); *H01R 13/582* (2013.01)

(58) Field of Classification Search
USPC ..... 439/582, 585, 63, 394
See application file for complete search history.

(56) References Cited

U.S. PATENT DOCUMENTS

| | | | | |
|---|---|---|---|---|
| 8,272,894 | B2 * | 9/2012 | Chiu | H01R 4/184 439/582 |
| 8,475,206 | B2 * | 7/2013 | Kubo | H01R 9/0518 439/582 |
| 8,905,782 | B2 * | 12/2014 | Zhao | H01R 9/0524 439/582 |
| 2010/0304609 | A1 | 12/2010 | Lee et al. | |
| 2012/0142211 | A1 | 6/2012 | Kubo | |

FOREIGN PATENT DOCUMENTS

| | | | |
|---|---|---|---|
| EP | 1 073 146 | A1 | 1/2001 |
| JP | 2005-038765 | A | 2/2005 |
| JP | 2012-243441 | A | 12/2012 |
| JP | 2013-525994 | A | 6/2013 |
| JP | 2013-222685 | A | 10/2013 |
| JP | 2015-015175 | A | 1/2015 |
| JP | 2015-15177 | A | 1/2015 |

OTHER PUBLICATIONS

An Office Action issued by the Korean Patent Office dated Mar. 16, 2018, which corresponds to Korean Patent Application No. 10-2017-0063409 and is related to U.S. Appl. No. 15/602,782; with English language translation.

* cited by examiner

CONNECTOR ASSEMBLY AND ELECTRICAL CONNECTOR

CROSS-REFERENCE TO RELATED APPLICATIONS

This application is based upon and claims the benefit of priority from Japanese Patent Application No. 2016-103967, filed May 25, 2016, the entire contents of which are incorporated herein by reference.

BACKGROUND

1. Field

The present disclosure relates to a connector assembly and an electrical connector.

2. Disclosure of the Related Art

In general, a plurality of coaxial cables are wired inside small devices such as mobile phones in order to transmit a high frequency signal between circuit boards. A plug connector is provided at a tip of the coaxial cable. A receptacle connector is mounted on the circuit board. When the plug connector is fitted to the receptacle connector, the coaxial cable and the circuit board are electrically connected.

Japanese Unexamined Patent Publication No. 2013-222685 discloses an example of a plug connector. The plug connector includes a conductive signal contact conductor, a conductive ground contact conductor and an insulating housing made of an insulating material. An internal conductor of a coaxial cable is connected to the signal contact conductor. An external conductor of the coaxial cable is connected to the ground contact conductor. The insulating housing holds the signal contact conductor therein and insulates the signal contact conductor from the ground contact conductor.

The ground contact conductor includes a cylindrical main body capable of housing an insulating housing, a lid that integrally extends from the edge of the main body in a cylinder axis direction of the main body, and a pair of arm portions that protrude from edges of the main body in a radially outward direction of the main body. The insulating housing includes an insulating main body having a cylindrical shape and a protrusion that protrudes from a peripheral surface of the insulating main body in a radially outward direction of the insulating main body. The insulating main body is disposed in the main body of the ground contact conductor to extend with the same axial state as the main body. The protrusion is disposed between a pair of arm portions of the ground contact conductor.

A recessed groove that linearly extends from an end surface of the protrusion into the insulating main body is provided in the insulating housing. When the coaxial cable is attached to the plug connector, the internal conductor of the coaxial cable is disposed in the recessed groove to extend along the recessed groove.

SUMMARY

A connector assembly according to one aspect of the present disclosure includes an electrical connector configured to be fittable to a mating connector mounted on a circuit board and a coaxial cable that is connected to the electrical connector. The coaxial cable includes an internal conductor that is electrically connected to a conductor on the circuit board when the electrical connector and the mating connector are fitted; a cylindrical insulator that covers the internal conductor; and a cylindrical external conductor that covers the insulator. The external conductor, the insulator and the internal conductor are exposed stepwise in that order toward a tip. The electrical connector includes a conductive signal contact conductor to which the internal conductor is connected; a conductive ground contact conductor to which the external conductor is connected; and an insulating housing that insulates the signal contact conductor from the ground contact conductor. The insulating housing includes a cylindrical insulating main body in which the signal contact conductor is held; and a protrusion that protrudes from a peripheral surface of the insulating main body in a radially outward direction of the insulating main body. The ground contact conductor includes a cylindrical main body in which the insulating main body is accommodated. The protrusion includes a base portion on which the insulator and the external conductor are placed; and a pair of walls that are erected on the base portion and are disposed to interpose at least a tip of the external conductor therebetween.

An electrical connector according to another aspect of the present disclosure is configured to be fittable to a mating connector mounted on a circuit board and includes an internal conductor that is electrically connected to a conductor on the circuit board when fitted to the mating connector, a cylindrical insulator that covers the internal conductor, and a cylindrical external conductor that covers the insulator, wherein the electrical connector is connected to a coaxial cable in which the external conductor, the insulator and the internal conductor are exposed stepwise in that order toward a tip. The electrical connector includes a conductive signal contact conductor to which the internal conductor is connected; a conductive ground contact conductor to which the external conductor is connected; and an insulating housing that insulates the signal contact conductor from the ground contact conductor. The insulating housing includes a cylindrical insulating main body in which the signal contact conductor is held; and a protrusion that protrudes from a peripheral surface of the insulating main body in a radially outward direction of the insulating main body. The ground contact conductor includes a cylindrical main body in which the insulating main body is accommodated. The protrusion includes a base portion on which the insulator and the external conductor are placed, and a pair of walls that are erected on the base portion and form a space in which at least a tip of the external conductor is able to be disposed with the base portion.

DETAILED DESCRIPTION

Figure 1:
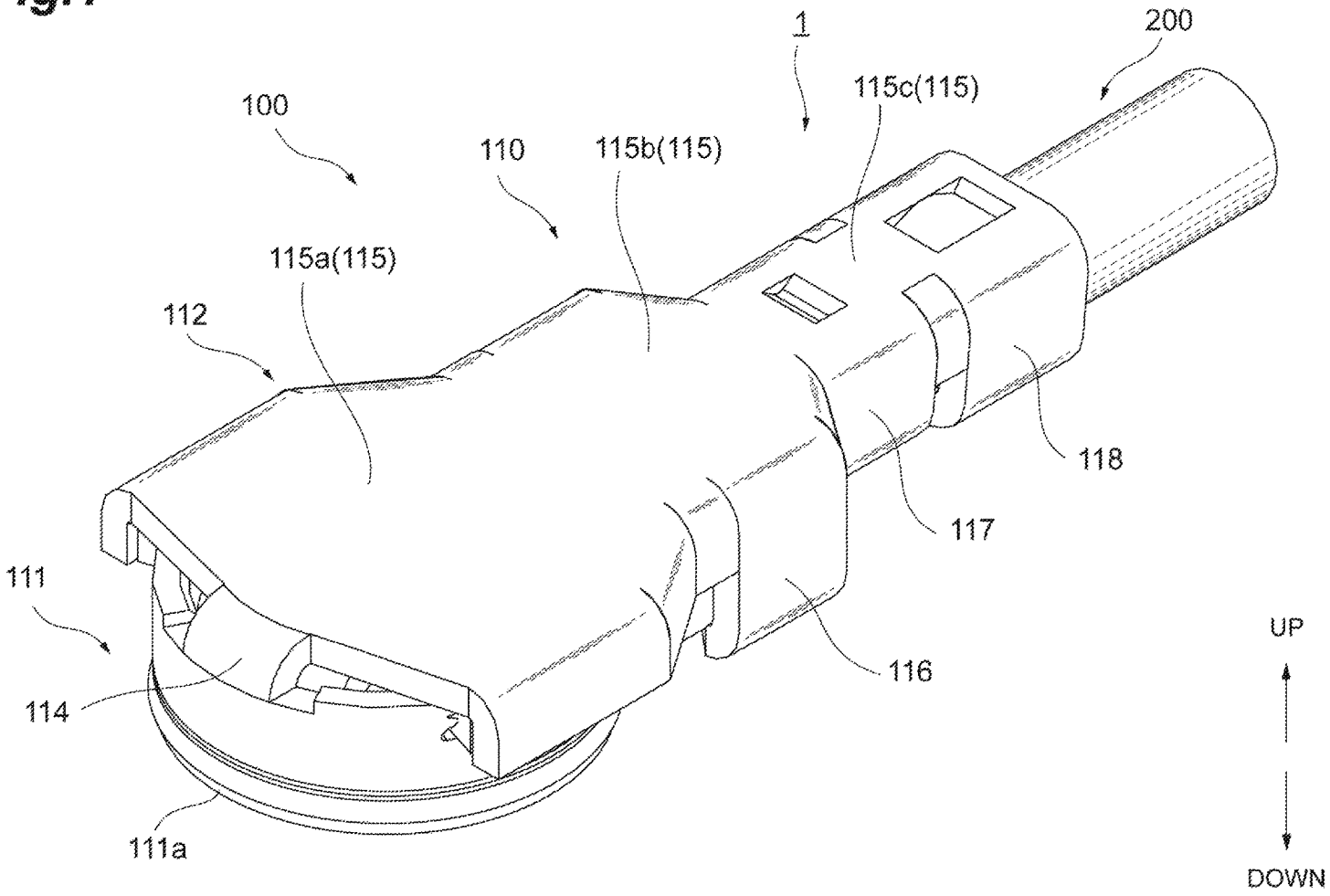
FIG. 1 is a perspective view of a connector assembly.

Embodiments according to the present disclosure described below are by way of illustration for explaining the present invention, and the present invention should not be limited to the contents below.

<Embodiment Overview>

(1) A connector assembly according to one aspect of the present disclosure includes an electrical connector configured to be fittable to a mating connector mounted on a circuit board and a coaxial cable that is connected to the electrical connector. The coaxial cable includes an internal conductor that is electrically connected to a conductor on the circuit board when the electrical connector and the mating connector are fitted; a cylindrical insulator that covers the internal conductor; and a cylindrical external conductor that covers the insulator. The external conductor, the insulator and the internal conductor are exposed stepwise in that order toward a tip. The electrical connector includes a conductive signal contact conductor to which the internal conductor is connected; a conductive ground contact conductor to which the external conductor is connected; and an insulating housing that insulates the signal contact conductor from the ground contact conductor. The insulating housing includes a cylindrical insulating main body in which the signal contact conductor is held; and a protrusion that protrudes from a peripheral surface of the insulating main body in a radially outward direction of the insulating main body. The ground contact conductor includes a cylindrical main body in which the insulating main body is accommodated. The protrusion includes a base portion on which the insulator and the external conductor are placed; and a pair of walls that are erected on the base portion and are disposed to interpose at least a tip of the external conductor therebetween.

In the connector assembly according to the aspect of the present disclosure, the insulating housing includes a protrusion that protrudes from a peripheral surface of the insulating main body in a radially outward direction of the insulating main body. The protrusion includes a base portion on which the insulator and the external conductor are placed and a pair of walls that are erected on the base portion and are disposed to interpose at least a tip of the external conductor therebetween. Therefore, a tip that easily becomes loose in the external conductor is protected by the pair of walls. Therefore, even if the external conductor of the coaxial cable loosens, it is possible to prevent the external conductor from spreading outward. Accordingly, the loosened metal wire of the external conductor is less likely to be torn off. In addition, since the loosened metal wire of the external conductor is less likely to extend outward from the electrical connector, it is possible to prevent the occurrence of a short circuit between the loosened metal wire and the signal contact conductor of the mating connector.

(2) In the connector assembly according to the section (1), the pair of walls may be disposed to interpose at least a part of the insulator and at least a tip of the external conductor therebetween, the pair of walls may include first parts that face at least a part of the insulator and second parts that face at least a tip of the external conductor, and a separation distance between the first parts may be smaller than a separation distance between the second parts. The diameter of the insulator is smaller than the diameter of the external conductor. Therefore, according to a connector assembly in which a separation distance between the first parts is smaller than a separation distance between the second parts, inner wall surfaces of the pair of walls have a shape corresponding to an external form of the insulator and the external conductor. Accordingly, since both the insulator and the external conductor are guided by the pair of walls, it is possible to prevent deflection of the insulator and the external conductor by the pair of walls.

(3) In the connector assembly according to the section (1), at least a part of the insulator may not be covered with the pair of walls. In this case, there is not the insulating housing except for the base portion around the insulator but air around the insulator. Here, a relative dielectric constant of air is about 1, which is smaller than a relative dielectric constant of a material (for example, a resin) forming the insulating housing. When the relative dielectric constant is low, an electrostatic capacitance value that is in proportional to the relative dielectric constant is also low. Therefore, it is possible to relatively increase a characteristic impedance having a property that is inversely proportional to an electrostatic capacitance value. Accordingly, even if the electrical connector is reduced in size and height, it is easy to match a characteristic impedance with a desired value (for example, 50 Ω).

(4) In the connector assembly according to any one of the sections (1) to (3), a recessed groove which extends toward the insulating main body and in which the internal conductor is arranged may be provided in the protrusion. In this case, since the internal conductor is guided by the recessed groove, it is possible to prevent deflection of the internal conductor by the recessed groove.

(5) In the connector assembly according to any one of the sections (1) to (4), the ground contact conductor may further include a pair of arm portions, a slit that extends in an extending direction thereof may be provided in the main body, the pair of arm portions may protrude from edges forming the slit of the main body in a radially outward direction of the main body, a pair of engaged portions may be provided on side surfaces of the protrusion, and an engaging portion engageable to a corresponding one engaged portion of the pair of engaged portions may be provided in each of the pair of arm portions. In this case, when the engaging portion is engaged to the engaged portion, the insulating housing is held by the ground contact conductor. Therefore, if the coaxial cable is placed in the insulating housing when the connector assembly is produced, the insulating housing is prevented from moving to the ground contact conductor. Accordingly, it is possible to stably produce the connector assembly.

(6) In the connector assembly according to any one of the sections (1) to (5), the ground contact conductor may further include a lid that extends from an edge on a side distant from the circuit board in the main body, a fixing portion that grips the protrusion by being wound around the protrusion until it reaches a surface on a side that faces the circuit board in the protrusion may be provided in the lid, and the fixing portion may protrude toward the circuit board relative to the main body. In this case, an amount of protrusion of the main body of the ground contact conductor to the circuit board side is reduced. Therefore, it is possible to reduce the height of the electrical connector.

(7) An electrical connector according to another aspect of the present disclosure is configured to be fittable to a mating connector mounted on a circuit board and includes an internal conductor that is electrically connected to a conductor on the circuit board when fitted to the mating connector, a cylindrical insulator that covers the internal conductor, and a cylindrical external conductor that covers the insulator, wherein the electrical connector is connected to a coaxial cable in which the external conductor, the insulator and the internal conductor are exposed stepwise in that order toward a tip. The electrical connector includes a conductive signal contact conductor to which the internal conductor is connected; a conductive ground contact conductor to which the external conductor is connected; and an insulating housing that insulates the signal contact conductor from the ground contact conductor. The insulating housing includes a cylindrical insulating main body in which the signal contact conductor is held; and a protrusion that protrudes from a peripheral surface of the insulating main body in a radially outward direction of the insulating main body. The ground contact conductor includes a cylindrical main body in which the insulating main body is accommodated. The protrusion includes a base portion on which the insulator and the external conductor are placed, and a pair of walls that are erected on the base portion and form a space in which at least a tip of the external conductor is able to be disposed with the base portion. The electrical connector according to another aspect of the present disclosure has the similar operations and effects as in the connector assembly according to the section (1).

(8) In the electrical connector according to the section (7), the pair of walls may form a space in which at least a part of the insulator and at least a tip of the external conductor are able to be disposed with the base portion, the pair of walls may include first parts that are formed to face at least a part of the insulator and second parts that are formed to face at least a tip of the external conductor, and a separation distance between the first parts may be smaller than a separation distance between the second parts. In this case, the similar operations and effects as in the connector assembly according to the section (2) can be obtained.

(9) In the electrical connector according to the section (7), the pair of walls may form a space in which at least a tip of the external conductor is able to be disposed with the base portion, and the pair of walls may not be provided in a region that faces at least a part of the insulator. In this case, the similar operations and effects as in the connector assembly according to the section (3) are obtained.

(10) In the electrical connector according to any one of the sections (7) to (9), a recessed groove which extends toward the insulating main body and in which the internal conductor is able to be arranged may be provided in the protrusion. In this case, the similar operations and effects as in the connector assembly according to (4) are obtained.

(11) In the electrical connector according to any one of the sections (7) to (10), the ground contact conductor may further include a pair of arm portions, a slit that extends in an extending direction thereof may be provided in the main body, the pair of arm portions may protrude from edges forming the slit of the main body in a radially outward direction of the main body, a pair of engaged portions may be provided on side surfaces of the protrusion, and an engaging portion engageable to a corresponding one engaged portion of the pair of engaged portions may be provided in each of the pair of arm portions. In this case, the similar operations and effects as in the connector assembly according to (5) are obtained.

(12) In the electrical connector according to any one of the sections (7) to (11), the ground contact conductor may further include a lid that extends from an edge on a side distant from the circuit board in the main body, a fixing portion that grips the protrusion by being wound around the protrusion until it reaches a surface on a side that faces the circuit board in the protrusion may be provided in the lid, and the fixing portion may protrude toward the circuit board relative to the main body. In this case, the similar operations and effects as in the connector assembly according to the section (6) are obtained.

<Illustration of Embodiment>

An example of embodiments according to the present disclosure will be described in more details below with reference to the drawings. In the following description, the same elements or the elements having the same functions are denoted with the same signs and overlapping descriptions thereof will be omitted.

[Connector Assembly]

As shown in FIG. 1 to FIG. 6, a connector assembly 1 is an article in which a plug connector 100 that is a type of an electrical connector is connected to a tip portion of a coaxial cable 200. As shown in FIG. 1 to FIG. 6, the plug connector 100 includes a ground contact conductor 110, an insulating housing 120, and a signal contact conductor 130. The plug connector 100 is configured to be fitted to or removed from a mating connector (for example, a receptacle connector) (not shown) mounted on a circuit board (not shown) built into a small terminal such as a mobile phone. When the plug connector 100 approaches the receptacle connector in a direction substantially orthogonal to a main surface of the circuit board, the plug connector 100 is fitted to the receptacle connector. On the other hand, when the plug connector 100 is separated from the receptacle connector in a direction substantially orthogonal to the main surface of the circuit board, the plug connector 100 is removed from the receptacle connector. Here, in this specification, a direction (an insertion direction) in which the plug connector 100 is fitted to the receptacle connector is referred to as "downward" and a direction in which the plug connector 100 is removed from the receptacle connector is referred to as "upward."

[Coaxial Cable]

Figure 4:
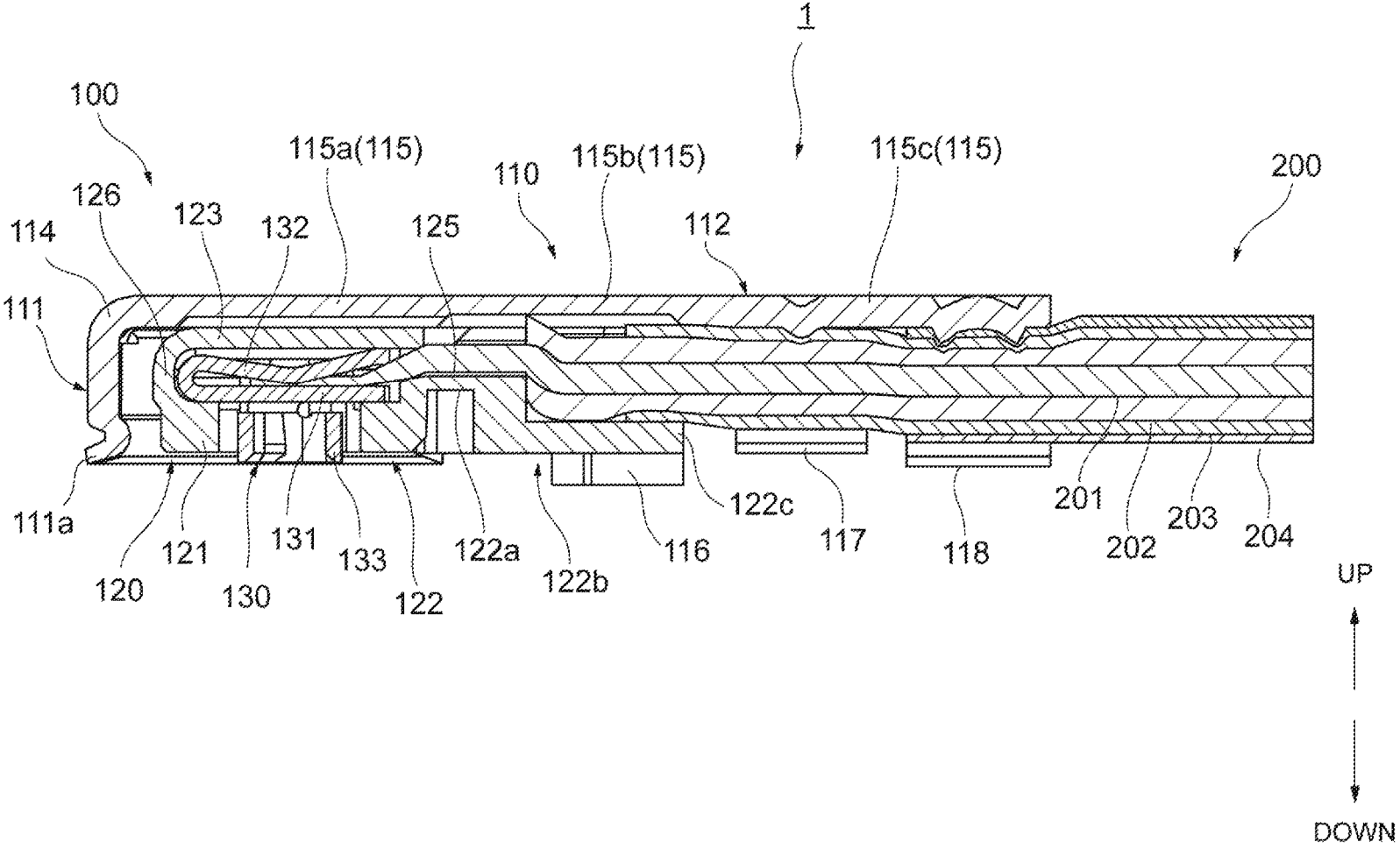
FIG. 4 is a cross-sectional view taken along the IV-IV in FIG. 3.
Figure 5:
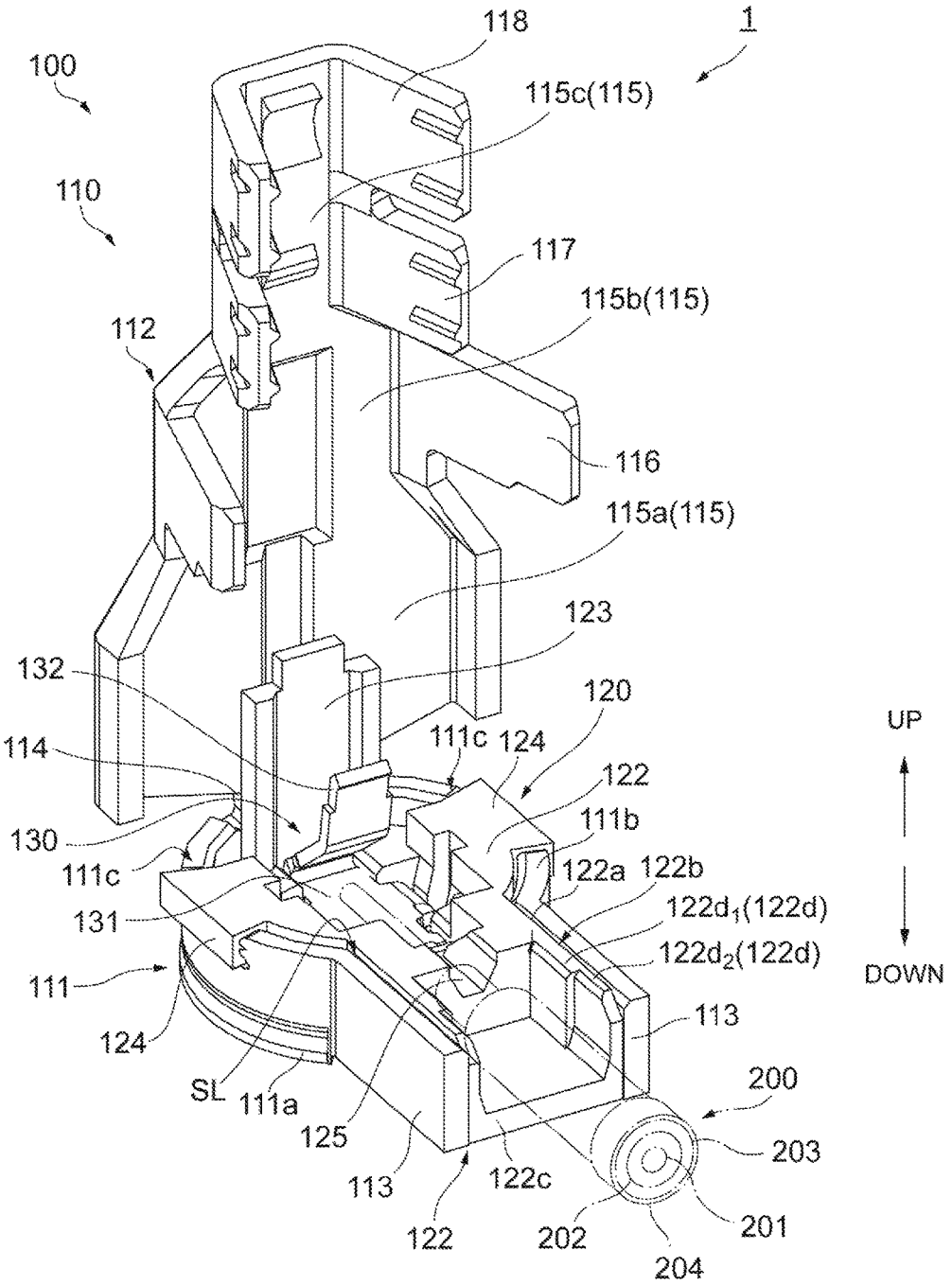
FIG. 5 is a perspective view of a plug connector in an open state.

The coaxial cable 200 is a wire that is used in a small terminal such as a mobile phone in order to transmit a high frequency signal between various circuit boards built into the small terminal. As shown in FIG. 4 and FIG. 5, the coaxial cable 200 includes an internal conductor 201, an insulator 202, an external conductor 203, and a protective coating 204.

The internal conductor 201 is a metal wire (for example, a copper wire) that extends linearly. The internal conductor 201 may be formed of one metal wire or a braided net wire in which a plurality of fine metal wires are knitted. The internal conductor 201 functions as a signal line through which an electric signal such as a high frequency signal flows. The insulator 202 has a cylindrical shape and is made of an insulating material (for example, polyethylene). The internal conductor 201 is inserted into the cylinder of the insulator 202. Accordingly, the insulator 202 covers a peripheral surface of the internal conductor 201.

The external conductor 203 has a cylindrical shape and is formed of a braided net wire (a mesh or spiral shape) in which a plurality of fine metal wires (for example, fine copper wires) are knitted. The insulator 202 is inserted into the cylinder of the external conductor 203. Accordingly, the external conductor 203 covers a peripheral surface of the insulator 202 and is not electrically connected to the internal conductor 201 due to the insulator 202. The external conductor 203 functions as a ground (GND). The protective coating 204 has a cylindrical shape and is made of an insulating material (for example, polyethylene, polyvinyl chloride or the like). The external conductor 203 is inserted into the cylinder of the protective coating 204. Accordingly, the protective coating 204 covers a peripheral surface of the external conductor 203 and protects the external conductor 203 from being electrically connected to another conductor.

When the coaxial cable 200 is connected to the plug connector 100, the coaxial cable 200 is processed. Specifically, as shown in FIG. 4 and FIG. 5, the external conductor 203, the insulator 202 and the internal conductor 201 are exposed stepwise in that order toward the tip of the coaxial cable 200.

[Ground Contact Conductor]

The ground contact conductor 110 is formed of a pressed metal sheet. Accordingly, the ground contact conductor 110 has conductivity. The ground contact conductor 110 includes a main body 111 and a lid 112.

The main body 111 is a cylindrical body, and a slit SL that extends in an extending direction (a cylinder axis direction) of the main body 111 is formed on a peripheral surface of the main body 111 (refer to FIG. 3 and FIG. 5 to FIG. 7). That is, the main body 111 has an arc shape when viewed in the cylinder axis direction. The main body 111 is fittable to the receptacle connector to cover the outside of the receptacle connector. Also, the main body 111 may be Liftable to the receptacle connector to be covered from the outside by the receptacle connector. When the main body 111 is fitted to the receptacle connector, a bottom edge 111*a* (an edge on a side that faces the circuit board in the main body 111) positioned in the vicinity of the slit SL in the main body 111 is elastically deformed.

Figure 6:
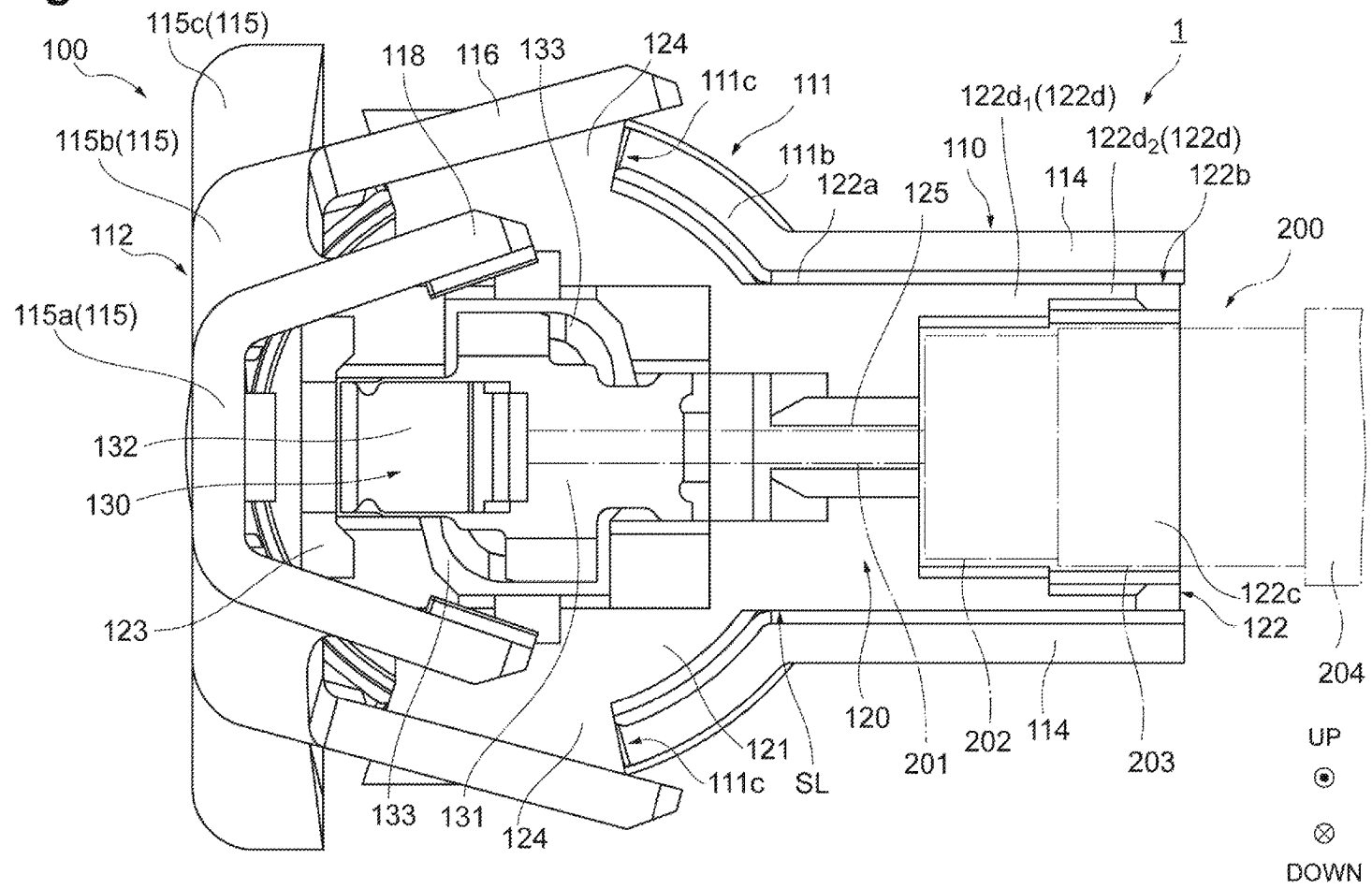
FIG. 6 is a top view of the plug connector in an open state.
Figure 7:
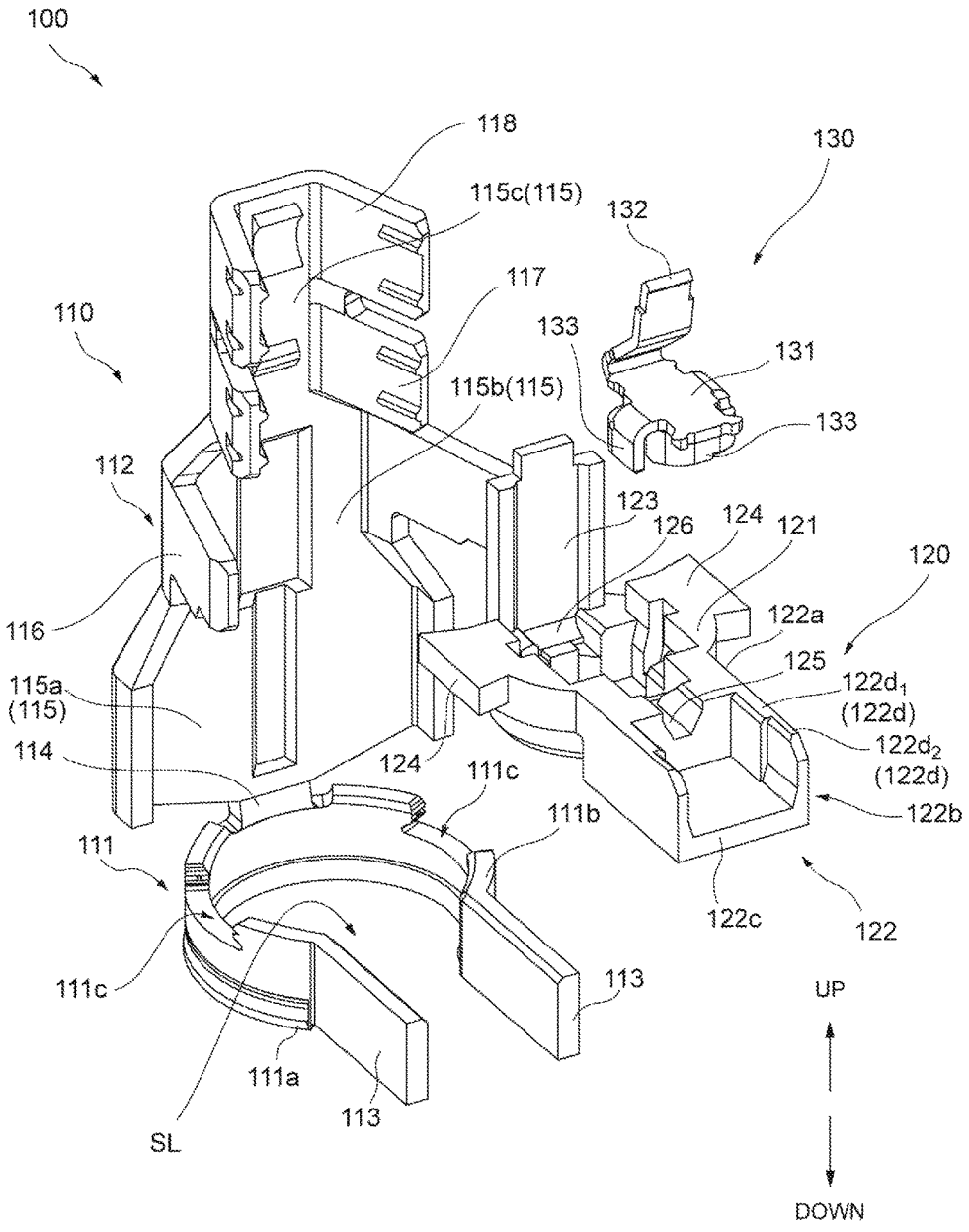
FIG. 7 is an exploded perspective view of the plug connector.

As shown in FIG. 2, FIG. 3 and FIG. 5 to FIG. 7, arm portions 113 are integrally provided at side edges forming the slit SL in the main body 111. The arm portions 113 protrude from the side edges forming the slit SL in the main body 111 in a radially outward direction of the main body 111 so that they extend in parallel to each other. As shown in FIG. 5 to FIG. 7, a pair of notches 111*c* having a recessed shape are provided in an upper edge 111*b* (an edge on a side in which a connecting portion 114 to be described below in the main body 111 is positioned) of the main body 111.

As shown in FIG. 1, FIG. 2, FIG. 4, FIG. 5 and FIG. 7, the lid 112 is connected to the main body 111 through the connecting portion 114. As shown in FIG. 1 to FIG. 5, the lid 112 includes a shell portion 115 and a pair of fixing portions 116 to 118. The shell portion 115 includes a base end 115*a*, an intermediate portion 115*b*, and a tip 115*c*. The base end 115*a* is wider than the intermediate portion 115*b* and the tip 115*c* and is positioned between the connecting portion 114 and the intermediate portion 115*b*. The base end 115*a* is integrally provided with the upper edge 111*b* of the main body 111 through the connecting portion 114. Accordingly, when the connecting portion 114 is bent, the lid 112 swings about the connecting portion 114 and is able to approach and be separated from the main body 111. The intermediate portion 115*b* is wider than the tip 115*c* and is positioned between the base end 115*a* and the tip 115*c*. Accordingly, the lid 112 has a staircase shape that becomes narrower from the base end 115*a* toward the tip 115*c*.

Figure 2:
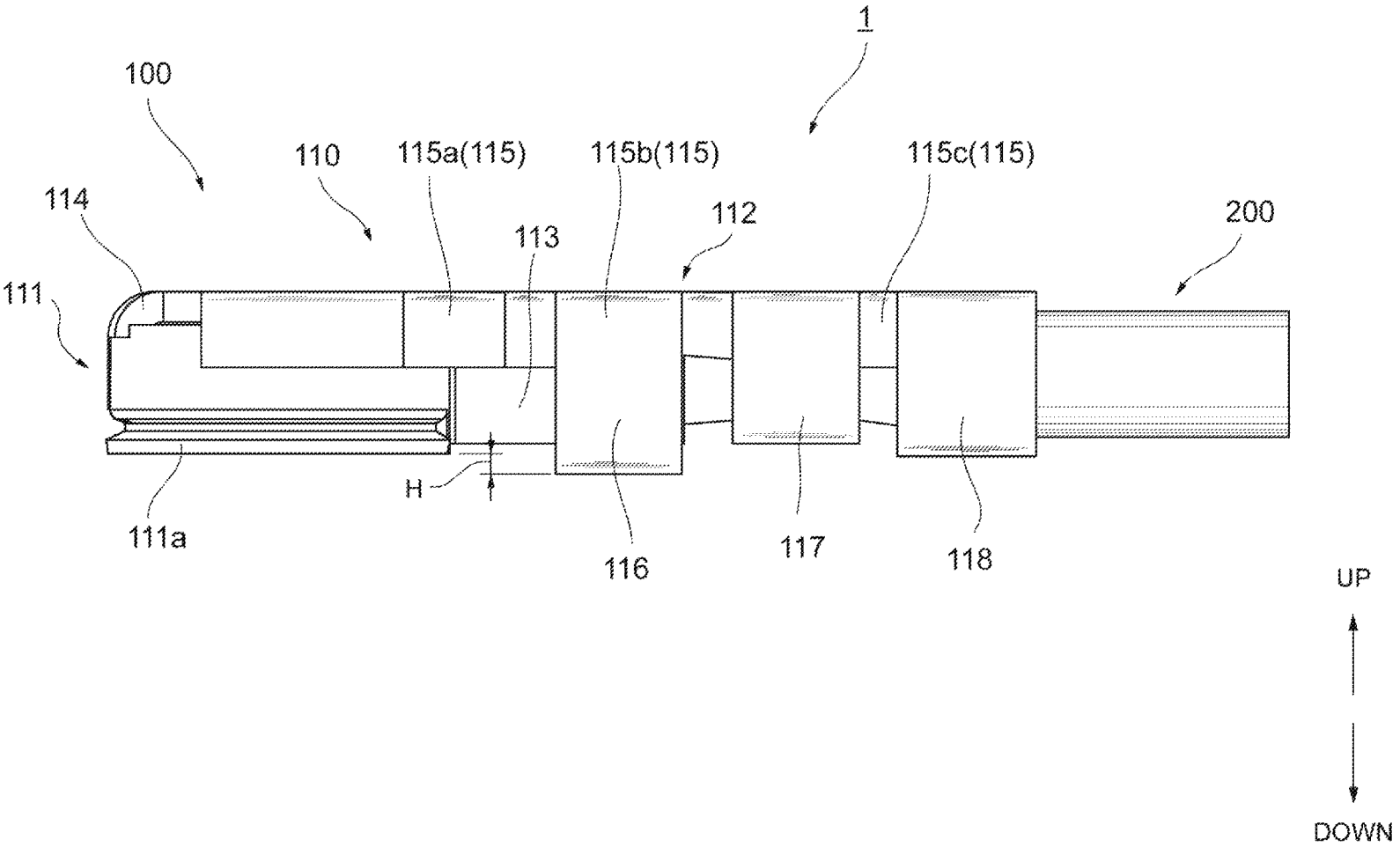
FIG. 2 is a side view of the connector assembly.
Figure 3:
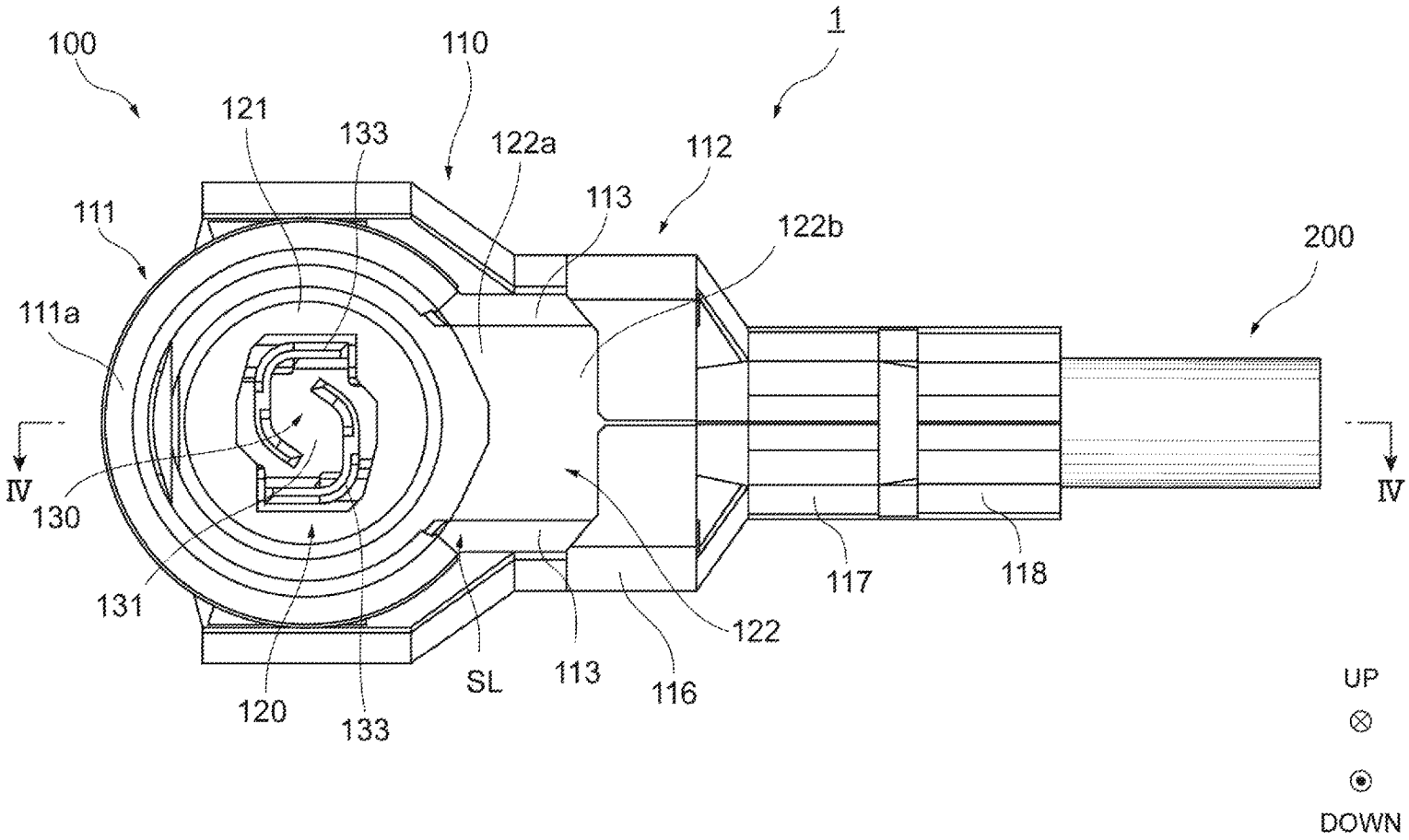
FIG. 3 is a bottom view of the connector assembly.

Before the coaxial cable 200 is attached to the plug connector 100, the connecting portion 114 is not bent, and the lid 112 stands upright relative to the main body 111 (in an upright standing state in which the lid 112 is separated from the main body 111) as shown in FIG. 5 to FIG. 7. On the other hand, when the lid 112 is folded through the connecting portion 114, the connecting portion 114 is bent, and the lid 112 faces the main body 111 (a prone state in which the lid 112 approaches the main body 111) as shown in FIG. 1 to FIG. 4. As shown in FIG. 3 and FIG. 4, in the prone state of the lid 112, the shell portion 115 covers the main body 111 and the aim portions 113. Specifically, in the prone state of the lid 112, the base end 115*a* covers the main body 111 and the intermediate portion 115*b* covers the arm portions 113. That is, the base end 115*a* corresponds to the main body 111 and the intermediate portion 115*b* corresponds to each of the arm portions 113.

The pair of fixing portions 116 are integrally provided with the intermediate portion 115*b*. The pair of fixing portions 117 and 118 are integrally provided with the tip 115*c*. The pair of fixing portions 116 to 118 are arranged in that order in a direction from the base end 115*a* toward the tip 115*c*. The pair of fixing portions 116 to 118 are cantilevered plate members.

As shown in FIG. 5 to FIG. 7, before the plug connector 100 is assembled, the pair of fixing portions 116 extend laterally from both side edges of the intermediate portion 115*b* and stand upright relative to the intermediate portion 115*b*, and have a substantially L-shape. Before the plug connector 100 is assembled, the pair of fixing portions 117 and 118 extend laterally from both side edges of the tip 115*c* and stand upright relative to the tip 115*c*, and have a substantially L-shape.

[Insulating Housing]

The insulating housing 120 is an insulator in which the signal contact conductor 130 is held and which insulates the ground contact conductor 110 from the signal contact conductor 130. The insulating housing 120 may be formed by injection molding using, for example, a resin material. As shown in FIG. 4 to FIG. 8, the insulating housing 120 includes an insulating main body 121, a protrusion 122, and a pressing portion 123.

The insulating main body 121 has a cylindrical shape and can hold the signal contact conductor 130 therein. The outer diameter of the insulating main body 121 is set to be smaller than the inner diameter of the main body 111 of the ground contact conductor 110. Accordingly, the insulating main body 121 is configured to be accommodatable in the main body 111 and a peripheral surface of the insulating main body 121 is covered with the main body 111.

A pair of engagement pieces 124 are integrally provided on the peripheral surface of the insulating main body 121. The pair of engagement pieces 124 are positioned at upper edges (edges on sides opposite to the circuit board in the insulating main body 121) of the insulating main body 121 in an extending direction (a cylinder axis direction) of the insulating main body 121. The pair of engagement pieces 124 protrude from the circumference surface of the insulating main body 121 in a radially outward direction. When the pair of engagement pieces 124 are engaged with the notch 111*c* of the main body 111, the insulating main body 121 is hooked to the main body 111. Accordingly, the insulating main body 121 is held in the main body 111.

As shown in FIG. 3 to FIG. 8, the protrusion 122 is integrally provided with the insulating main body 121 to protrude from the peripheral surface of the insulating main body 121 in a radially outward direction. The protrusion 122 is configured to support the internal conductor 201, the insulator 202 and the external conductor 203 of the coaxial cable 200. The entire protrusion 122 has a rectangular parallelepiped shape and is disposed between the pair of arm portions 113. Accordingly, a pair of side surfaces of the protrusion 122 are in contact with inner surfaces of the pair of arm portions 113, respectively. The protrusion 122 includes a base end 122*a* positioned closer to the insulating main body 121 and a tip 122*b* positioned outward relative to the base end 122*a*.

As shown in FIG. 5 to FIG. 8, a recessed groove 125 is formed on an upper surface (a surface on a side opposite to the circuit board in the base end 122*a*) of the base end 122*a*. The recessed groove 125 linearly extends to communicate the inside of the insulating main body 121 with the tip 122*b*. After the connector assembly 1 is completed, the internal conductor 201 of the coaxial cable 200 is arranged in the recessed groove 125.

The tip 122*b* includes a base portion 122*c* and a pair of walls 122*d*. Specifically, the base portion 122*c* has a flat plate shape and protrudes from a bottom end (a part on a side that faces the circuit board in the base end 122*a*) in the base end 122*a* in a radially outward direction of the insulating main body 121. After the connector assembly 1 is completed, a part of the insulator 202 and the external conductor 203 of the coaxial cable 200 is placed in the base portion 122*c*.

The pair of walls 122*d* have a plate shape. The pair of walls 122*d* are erected on the base portion 122*c* to extend upward from side edges of the base portion 122*c*. The pair of walls 122*d* each include first parts 122*d*1 and second parts 122*d*2.

Figure 8:
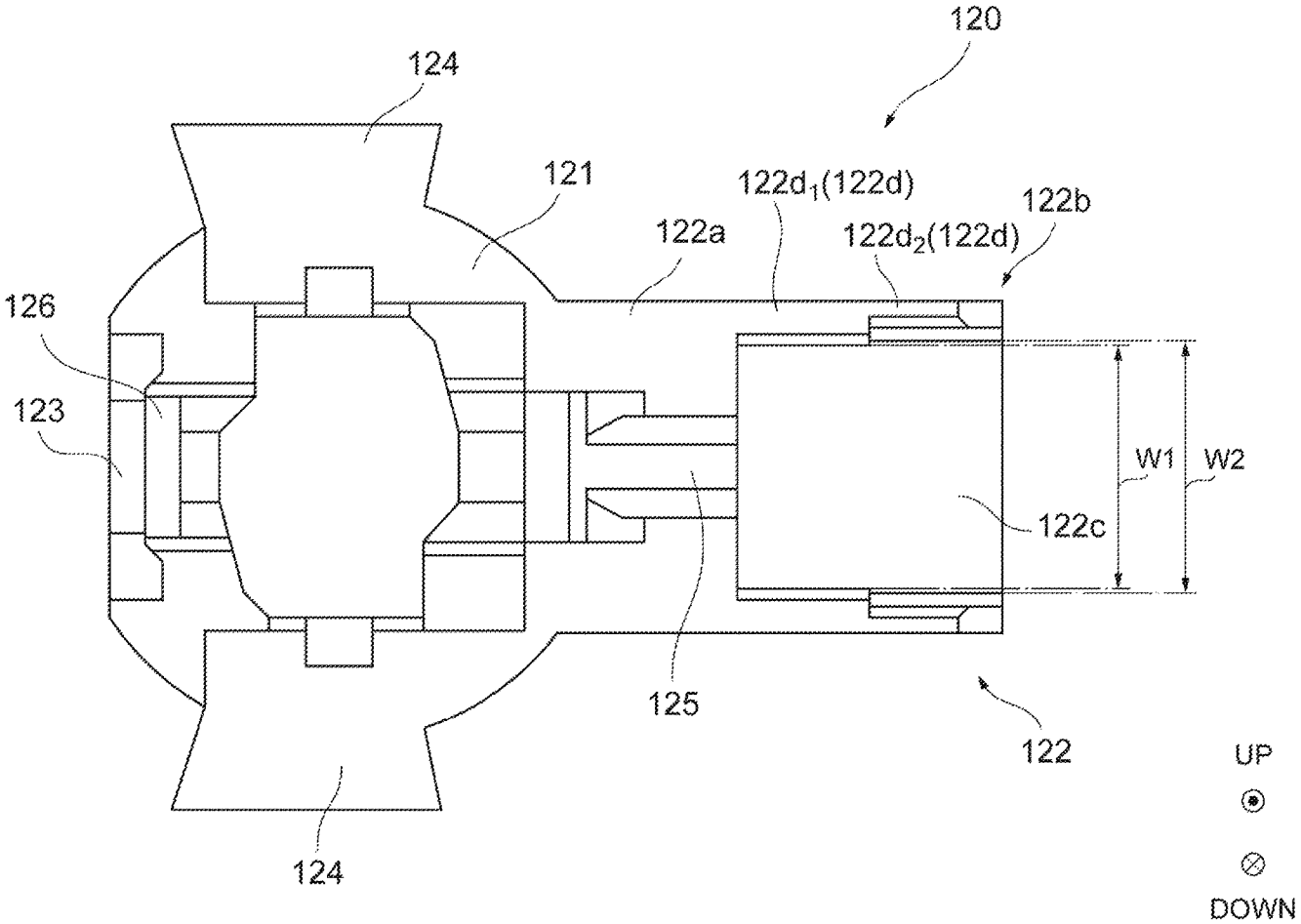
FIG. 8 is a top view of an insulating housing.

The first part 122*d*1 is integrally connected to the base end 122*a*. The second part 122*d*2 is positioned outward relative to the first part 122*d*1 and is integrally connected to the first part 122*d*1. As shown in FIG. 8, a separation distance W1 between the pair of first parts 122*d*1 is smaller than a separation distance W2 between the pair of second parts 122*d*2. That is, on inner wall surface sides of the pair of walls 122*d*, a step is provided between the first part 122*d*1 and the second part 122*d*2. On the other hand, an exterior wall surface of the first part 122*d*1 and an exterior wall surface of the second part 122*d*2 are continuous and form one plane.

The size (a value obtained by dividing a difference between the separation distance W2 and the separation distance W1 by 2) of the step may be the same as the thickness of the external conductor 203 of the coaxial cable 200 in the radial direction. For example, when the diameter of the metal wire of the external conductor 203 is about 0.05 mm, the size of the step may be about 0.05 mm to 0.06 mm.

The length of the second part 122*d*2 is not particularly limited as long as at least a tip of the external conductor 203 of the coaxial cable 200 can be covered with the pair of second parts 122*d*2. When the diameter of the coaxial cable 200 is about 0.6 mm to 0.8 mm, the length of the second part 122*d*2 may be about 0.15 mm.

As shown in FIG. 5 and FIG. 6, after the connector assembly 1 is completed, a part of the insulator 202 and the external conductor 203 of the coaxial cable 200 is positioned between the pair of walls 122*d*. More specifically, most of the insulator 202 exposed to the outside is positioned between the pair of first parts 122*d*1 and faces the pair of first parts 122*d*1. At least a tip of the external conductor 203 is positioned between the pair of second parts 122*d*2 and faces the pair of second parts 122*d*2. In other words, the base portion 122*c* and the pair of walls 122*d* form a space in which the insulator 202 and the external conductor 203 of the coaxial cable 200 can be disposed.

As shown in FIG. 4, FIG. 7 and FIG. 8, the pressing portion 123 is integrally provided with the insulating main body 121 through a connecting portion 126. Accordingly, when the connecting portion 126 is bent, the pressing portion 123 swings about the connecting portion 126 and is able to approach and be separated from the insulating main body 121. As shown in FIG. 5 and FIG. 6, before the coaxial cable 200 is attached to the plug connector 100, the pressing portion 123 stands upright relative to the insulating main body 121 and the protrusion 122 (in an upright standing state in which the pressing portion 123 is separated from the insulating main body 121 and the protrusion 122). On the other hand, when the pressing portion 123 is folded through the connecting portion 126, the connecting portion 126 is bent, and the pressing portion 123 faces the insulating main body 121 and the protrusion 122 (a prone state in which the pressing portion 123 approaches the insulating main body 121 and the protrusion 122) as shown in FIG. 4. In the prone state of the pressing portion 123, the pressing portion 123 is covered with the base end 115*a* of the shell portion 115 and faces the insulating main body 121 and the protrusion 122.

[Signal Contact Conductor]

Figure 9:
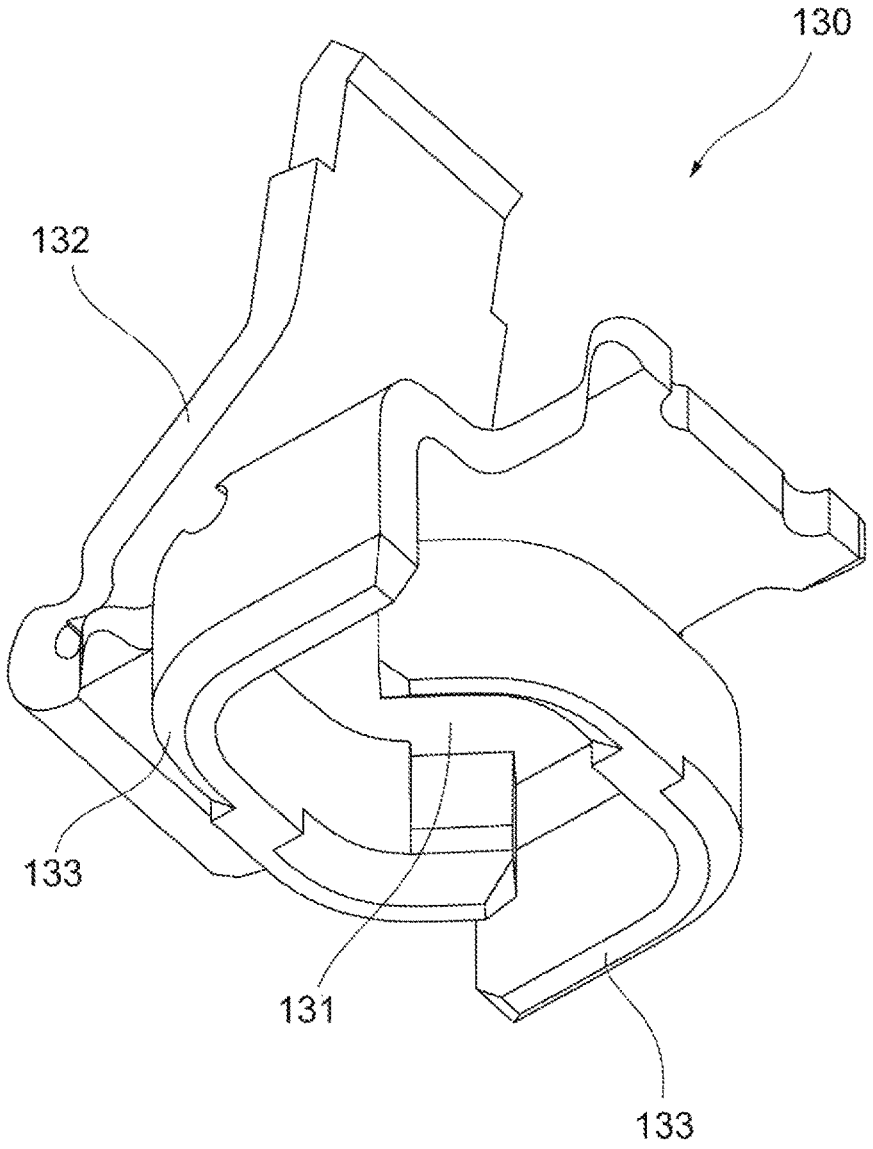
FIG. 9 is a perspective view of a signal contact conductor when viewed from below.

The signal contact conductor 130 is formed of a pressed metal sheet. Accordingly, the signal contact conductor 130 has conductivity. As shown in FIG. 7 and FIG. 9, the signal contact conductor 130 includes a base piece 131, a clamping piece 132, and a pair of connecting pieces 133.

The base piece 131 is a plate body having a rectangular shape. The clamping piece 132 is a cantilevered plate member. The clamping piece 132 is integrally provided with an edge of the base piece 131. The clamping piece 132 is positioned above the base piece 131. The clamping piece 132 has a bent portion that is bent to be protruded toward the base piece 131.

The pair of connecting pieces 133 are integrally provided with side edges of the base piece 131 and protrude downward from the base piece 131. The pair of connecting pieces 133 are cantilevered plate members having a substantially L-shape when viewed from below. The pair of connecting pieces 133 are fittable to the signal contact conductor of the receptacle connector. When the pair of connecting pieces 133 are fitted to the conductor contact of the receptacle connector, the pair of connecting pieces 133 are pushed and spread by the conductor contact and are elastically fitted to the conductor contact.

[Assembling Method]

Next, a method of assembling the ground contact conductor 110, the insulating housing 120 and the signal contact conductor 130, and attaching the plug connector 100 to a tip of the coaxial cable 200 will be described.

First, the coaxial cable 200 is processed. Specifically, the insulator 202, the external conductor 203 and the protective coating 204 are removed so that the external conductor 203, the insulator 202 and the internal conductor 201 are exposed stepwise in that order toward the tip of the coaxial cable 200.

Next, as shown in FIG. 5 to FIG. 7, in the main body 111 of the ground contact conductor 110 in which the lid 112 is in an upright standing state, the insulating housing 120 in which the pressing portion 123 is in an upright standing state is disposed. In this case, the insulating housing 120 is assembled to the ground contact conductor 110 so that the protrusion 122 of the insulating housing 120 is positioned between the pair of arm portions 113, and the pair of engagement pieces 124 of the insulating housing 120 are engaged with the pair of notches 111*c* of the main body 111.

Next, as shown in FIG. 5 to FIG. 7, the signal contact conductor 130 is placed in the insulating main body 121 of the insulating housing 120. In this case, the signal contact conductor 130 is supported by the insulating main body 121 while the connecting piece 133 is inserted into the insulating main body 121.

Next, the internal conductor 201 of the processed coaxial cable 200 is disposed on the base piece 131 (refer to FIG. 4 to FIG. 6). In this case, a portion close to the insulator 202 in the tip of the internal conductor 201 is accommodated inside the recessed groove 125 and a portion distant from the insulator 202 in the tip of the internal conductor 201 overlaps the base piece 131. Most of the insulator 202 of the coaxial cable 200 exposed to the outside is disposed between the pair of first parts 122*d*1. At least a tip of the external conductor 203 of the coaxial cable 200 is disposed between the pair of second parts 122*d*2.

In this state, the lid 112 is pushed down toward the main body until it is in a prone state. In this case, the pressing portion 123 of the insulating housing 120 is also pushed by the lid 112 and is pushed toward the insulating main body 121 until the pressing portion 123 is in a prone state. Therefore, the clamping piece 132 of the signal contact conductor 130 is pushed by the pressing portion 123 and the clamping piece 132 approaches the base piece 131. In this case, since a protruded bent portion of the clamping piece 132 is clamped by the pressing portion 123 and the internal conductor 201 of the coaxial cable 200, the entire clamping piece 132 is deformed into a flat shape. Therefore, as shown in FIG. 4, the internal conductor 201 of the coaxial cable 200 is sandwiched between the clamping piece 132 and the base piece 131. As a result, the signal contact conductor 130 and the internal conductor 201 of the coaxial cable 200 are electrically and physically connected and form a signal circuit.

Next, the pair of fixing portions 116 are folded to the pair of arm portions 113 so that the pair of fixing portions 116 cover the pair of arm portions 113 from the outside and wind around a bottom surface (a surface on a side that faces the circuit board) of the protrusion 122. Accordingly, the pair of fixing portions 116 grip the pair of arm portions 113 and the protrusion 122, and the lid 112 is fixed to the pair of arm portions 113 and the protrusion 122. In this case, as shown in FIG. 2, a bottom of the fixing portion 116 protrudes downward (toward the circuit board) from the bottom edge 111*a* of the main body 111.

Next, the pair of fixing portions 117 are folded to the external conductor 203 so that the pair of fixing portions 117 cover a part (a portion close to the protective coating 204) of the external conductor 203 of the coaxial cable 200. Therefore, the pair of fixing portions 117 are fixed to the external conductor 203. That is, the ground contact conductor 110 and the external conductor 203 of the coaxial cable 200 are electrically and physically connected and form a ground circuit.

Next, the pair of fixing portions 118 are folded to the protective coating 204 so that the pair of fixing portions 118 cover the protective coating 204 of the coaxial cable 200. Accordingly, the pair of fixing portions 118 are fixed to the protective coating 204.

Accordingly, the coaxial cable 200 is held by the lid 112 and the plug connector 100 is attached to the coaxial cable 200. In this manner, the connector assembly 1 is completed. In this case, the shell portion 115 covers the coaxial cable 200 from the internal conductor 201 to the tip of the protective coating 204 thereof. Then, when the plug connector 100 of the connector assembly 1 is fitted to the receptacle connector, the internal conductor 201 of the coaxial cable 200 is electrically connected to the signal circuit of the circuit board, and the external conductor 203 of the coaxial cable 200 is electrically connected to the ground circuit of the circuit board.

[Operations]

Here, a coaxial cable includes an internal conductor that extends along a central axis, a cylindrical insulator that covers the internal conductor, a cylindrical external conductor that covers the insulator, and a protective coating that covers the external conductor. In general, the external conductor is a braided net wire in which a plurality of fine metal wires (for example, copper wires) are knitted in a mesh or spiral shape. When the coaxial cable is assembled to the plug connector, the coaxial cable is partially cut off, and the external conductor, the insulator and the internal conductor are exposed stepwise in that order toward the tip of the coaxial cable. In this case, the braided net wire forming the external conductor may become loose and spread.

If the coaxial cable of which the external conductor has loosened is assembled to the plug connector, when a barrel of the ground contact conductor is crimped (caulked) around the external conductor, the loosened metal wire may be torn and fall off Alternatively, the loosened metal wire may extend outward from the plug connector and come in contact with a signal contact conductor of a mating connector (a receptacle connector), and an electrical short circuit may occur.

However, in the present embodiment described above, the insulating housing 120 includes the protrusion 122 that protrudes from a peripheral surface of the insulating main body 121 in a radially outward direction of the insulating main body 121. The protrusion 122 includes the base portion 122*c* on which the insulator 202 and the external conductor 203 of the coaxial cable 200 are placed and the pair of walls 122*d* that are erected on the base portion 122*c* and are disposed to interpose at least a tip of the external conductor 203 therebetween. Therefore, a tip that easily becomes loose in the external conductor 203 is protected by the pair of walls 122*d*. Therefore, even if the external conductor 203 of the coaxial cable 200 loosens, it is possible to prevent the external conductor 203 from spreading outward. Accordingly, the loosened metal wire of the external conductor 203 is less likely to be torn off. In addition, since the loosened metal wire of the external conductor 203 is less likely to extend outward from the plug connector 100, it is possible to prevent the occurrence of a short circuit between the loosened metal wire and the signal contact conductor of the receptacle connector.

In the present embodiment, the separation distance W1 between the pair of first parts 122*d*1 is smaller than the separation distance W2 between the pair of second parts 122*d*2. The diameter of the insulator 202 of the coaxial cable 200 is smaller than the diameter of the external conductor 203. Therefore, according to the plug connector 100 in which the separation distance W1 is smaller than the separation distance W2, inner wall surfaces of the pair of walls 122*d* have a shape corresponding to an external form of the insulator 202 and the external conductor 203. Accordingly, since both the insulator 202 and the external conductor 203 are stably guided by the pair of walls 122*d*, it is possible to prevent deflection of the insulator 202 and the external conductor 203 by the pair of walls 122*d*. In addition, since an exterior wall surface of the first part 122*d*1 and an exterior wall surface of the second part 122*d*2 are on the same plane, the first part 122*d*1 becomes thicker than the second part 122*d*2 in the wall 122*d*. Therefore, it is possible to increase the strength of the wall 122*d*.

In the present embodiment, the recessed groove 125 which extends toward the insulating main body 121 and in which the internal conductor 201 of the coaxial cable 200 is arranged is provided in the protrusion 122. Therefore, since the internal conductor 201 is stably guided by the recessed groove 125, it is possible to prevent deflection of the internal conductor 201 by the recessed groove 125.

In the present embodiment, after the connector assembly 1 is completed, a bottom of the fixing portion 116 protrudes downward (toward the circuit board) from the bottom edge 111*a* of the main body 111. Therefore, an amount of protrusion of the main body 111 of the ground contact conductor 110 to the circuit board side is reduced. Accordingly, it is possible to reduce the height of the plug connector 100.

[Other Embodiments]

While the embodiment according to the present disclosure has been described above in detail, various modifications within the scope of the present invention may be added to the above embodiment. For example, the present invention may be applied to another electrical connector (for example, a receptacle connector).

Figure 10:
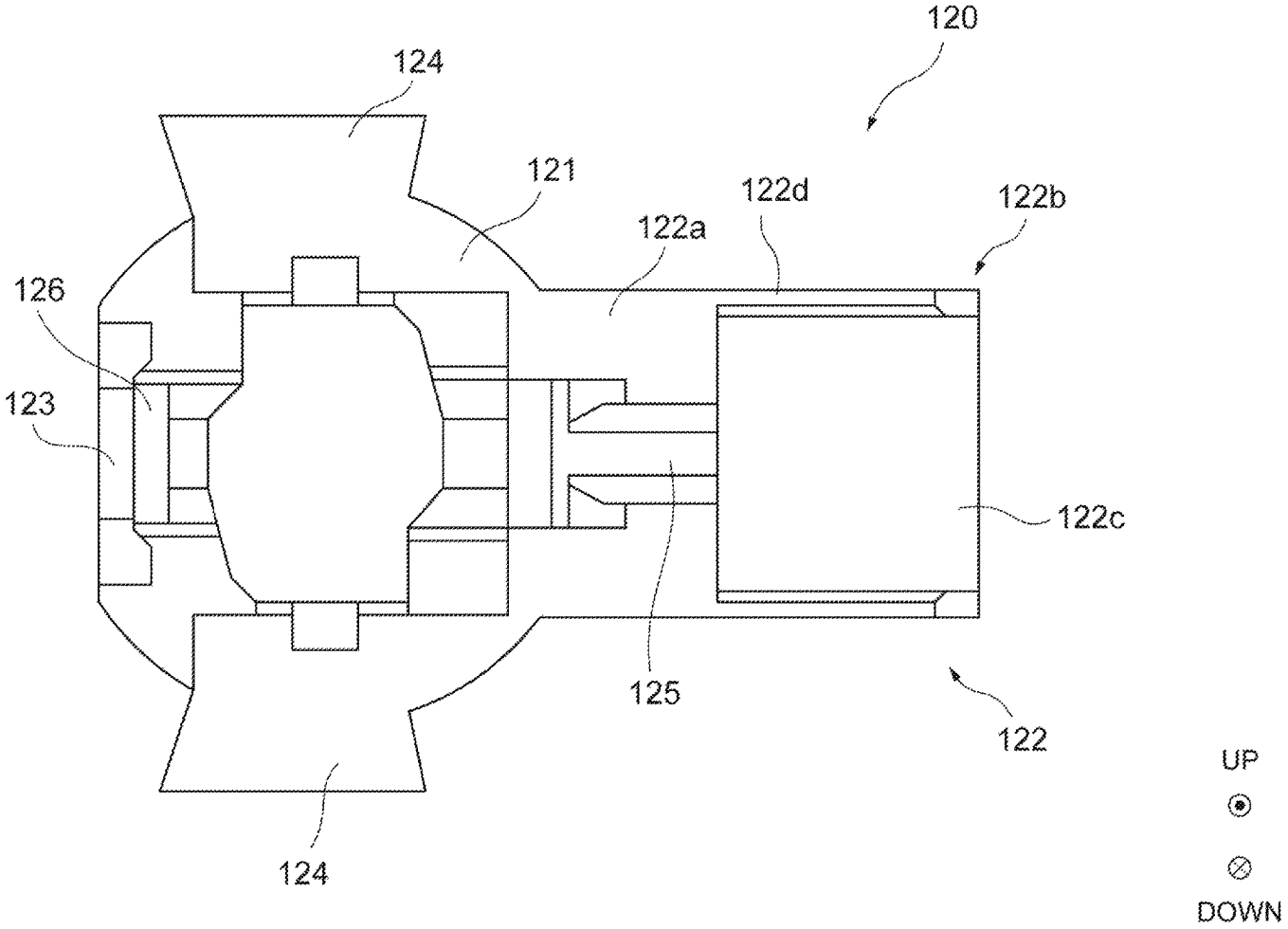
FIG. 10 is a top view of another example of the insulating housing.

The pair of walls 122*d* may not have a step. In this case, as shown in FIG. 10, inner wall surfaces of the pair of walls 122*d* may extend substantially in parallel in an extending direction thereof, may extend close to each other in an outward direction, may extend away from each other in an outward direction, or may be bent in a wave form.

A slit may be provided between the first part 122*d*1 and the second part 122*d*2, and the first part 122*d*1 and the second part 122*d*2 may be separated from each other.

Figure 11:
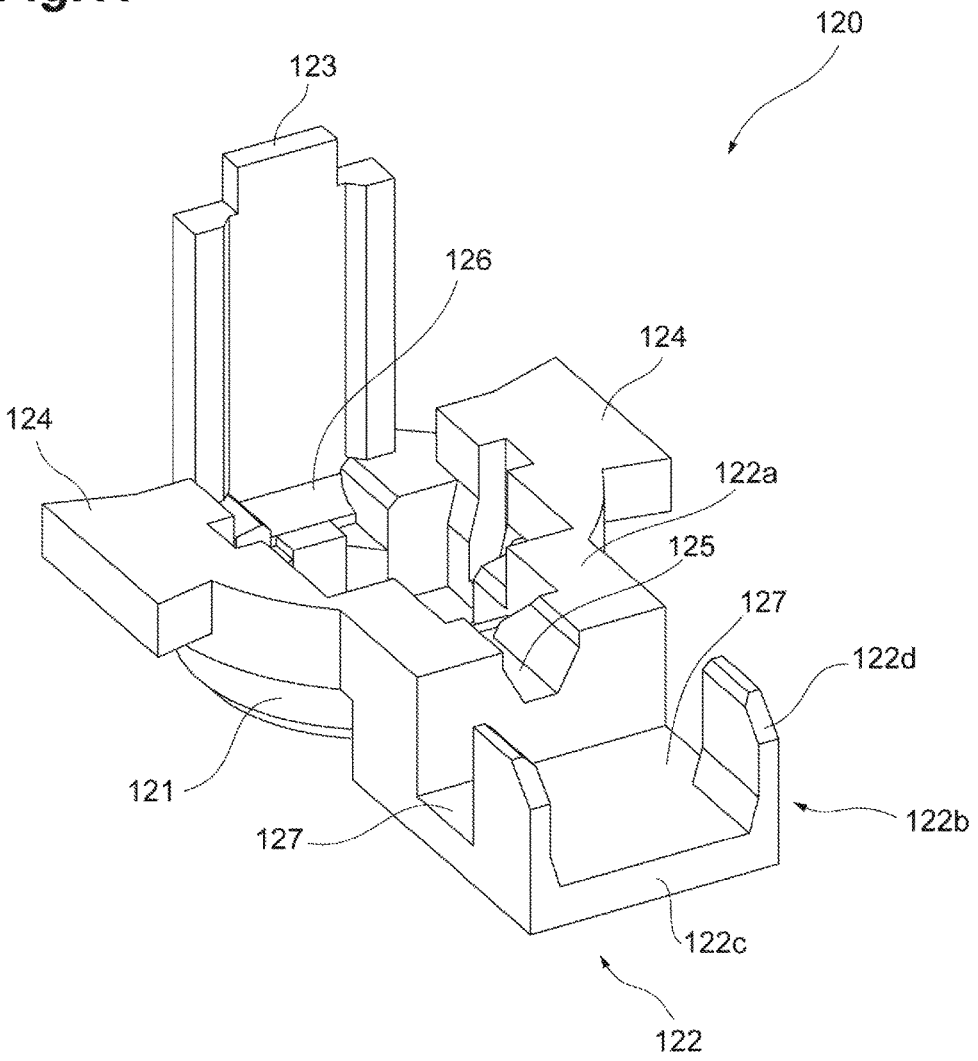
FIG. 11 is a perspective view of another example of the insulating housing.

As shown in FIG. 11, the wall 122*d* may not include a portion corresponding to the first part 122*d*1. That is, a notch 127 may be provided between the wall 122*d* and the base end 122*a*. In this case, most of the insulator 202 of the coaxial cable 200 is not covered with the pair of walls 122*d*. That is, there is not the insulating housing 120 except for the base portion 122*c* around the insulator 202 but air around the insulator 202. Here, a relative dielectric constant of air is about 1, which is smaller than a relative dielectric constant of a material (for example, a resin) forming the insulating housing 120. When the relative dielectric constant is low, an electrostatic capacitance value that is in proportional to the relative dielectric constant is also low.

Therefore, it is possible to relatively increase a characteristic impedance having a property that is inversely proportional to an electrostatic capacitance value. Accordingly, even if the plug connector 100 is reduced in size and height, it is easy to match a characteristic impedance with a desired value (for example, 50 Ω).

Figure 12:
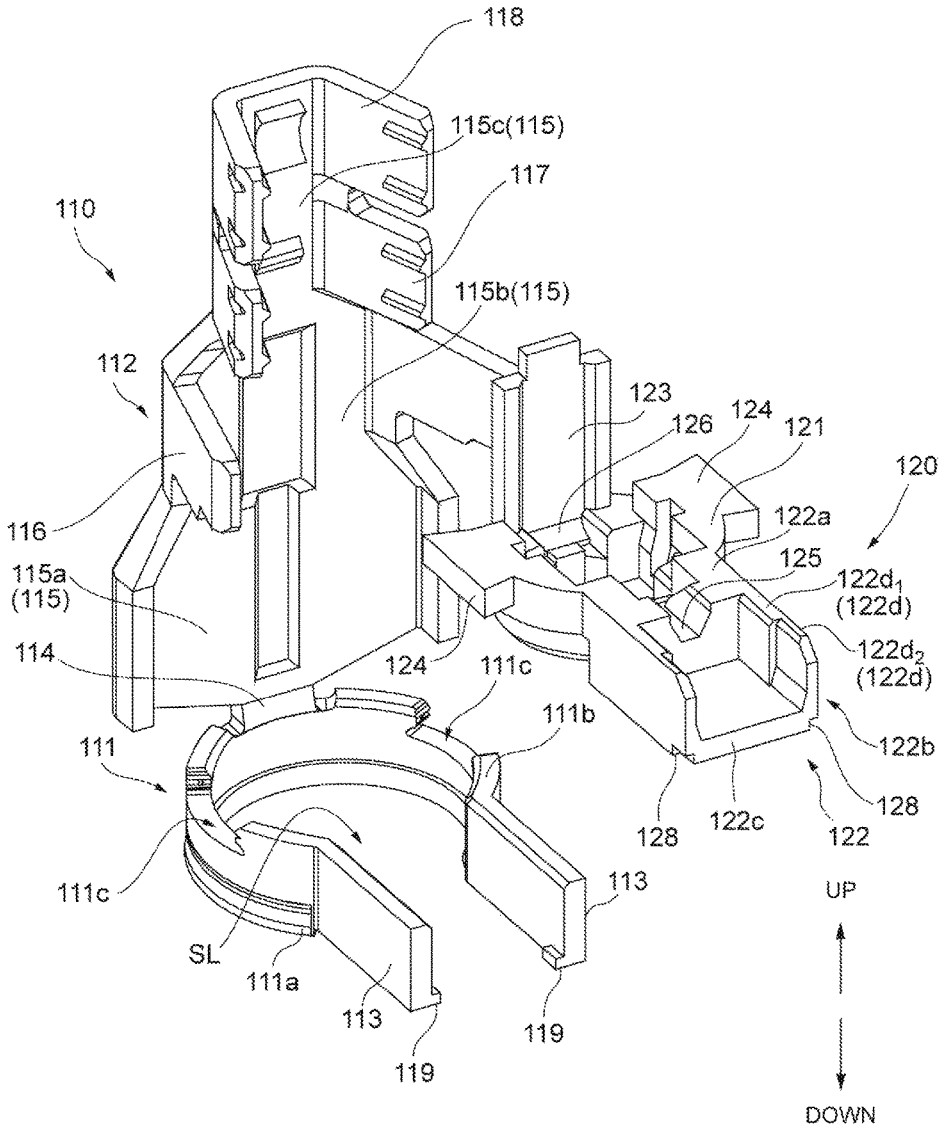
FIG. 12 is an exploded perspective view of another example of the insulating housing and the ground contact conductor.

As shown in FIG. 12, engaging portions 119 may be provided on the pair of arm portions 113 of the ground contact conductor 110, and a pair of engaged portions 128 may be provided on the protrusions 122 of the insulating housing 120. The engaging portion 119 provided on one arm portion 113 protrudes toward the other arm portion 113. The engaging portion 119 provided on the other arm portion 113 protrudes toward one arm portion 113. As exemplified in FIG. 12, while the engaging portion 119 may be a quadrangular prism-shaped protrusion, another shape may be used and a form other than a protrusion may be used as long as it can be engaged to the engaged portion 128.

As exemplified in FIG. 12, the engaged portion 128 is a recess having a shape corresponding to the engaging portion 119. The engaged portion 128 provided on one side surface of the protrusion 122 is recessed toward the other side surface of the protrusion 122. The engaged portion 128 provided on the other side surface of the protrusion 122 is recessed toward one side surface of the protrusion 122. The engaged portion 128 may have a form other than the recess as long as the engaging portion 119 can be engaged to the engaged portion 128.

Each of the engaging portions 119 is the tip of the corresponding arm portion 113 and is positioned in the vicinity of the lower edge. Each of the engaged portions 128 is positioned on the tip edge side of the corresponding side surface of the protrusion 122 and on the bottom edge side. However, positions of the engaging portion 119 and the engaged portion 128 are not particularly limited as long as the engaging portion 119 and the engaged portion 128 can be engaged.

When the engaging portion 119 is engaged to the corresponding engaged portion 128, the insulating housing 120 is held by the ground contact conductor 110. Therefore, if the coaxial cable 200 is placed on the insulating housing 120 when the connector assembly 1 is produced, the insulating housing 120 is prevented from moving to the ground contact conductor 110. Accordingly, it is possible to stably produce the connector assembly 1.

Indeed, the novel devices and methods described herein may be embodied in a variety of other forms; furthermore, various omissions, substitutions and changes in the form of the devices and methods described herein may be made without departing from the spirit of the inventions. The accompanying claims and their equivalents are intended to cover such forms or modification as would fall within the scope and spirit of the inventions.

Certain aspects, advantages, and novel features of the embodiment have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

What is claimed is:

1. A connector assembly comprising an electrical connector and a coaxial cable that is connected to the electrical connector, wherein the coaxial cable includes an internal conductor;

a cylindrical insulator that covers the internal conductor; and a cylindrical external conductor that covers the insulator, wherein the external conductor, the insulator and the internal conductor are exposed stepwise in that order toward a tip, wherein the electrical connector includes a conductive signal contact conductor to which the internal conductor is connected;

a conductive ground contact conductor to which the external conductor is connected; and an insulating housing that insulates the signal contact conductor from the ground contact conductor, wherein the insulating housing includes a cylindrical insulating main body in which the signal contact conductor is held; and a protrusion that protrudes from a peripheral surface of the insulating main body in a radially outward direction of the insulating main body, wherein the ground contact conductor includes a cylindrical main body in which the insulating main body is accommodated, the cylindrical main body including a connecting portion which extends from an upper edge of the cylindrical main body in a height direction of the cylindrical main body;

a lid that extends from the connecting portion so that the posture of the lid is changeable between an upright standing state and a prone state in which the lid approaches the cylindrical main body; and first and second arm portions, and wherein the protrusion includes a base portion on which the insulator and the external conductor are placed; and first and second walls that are erected on the base portion and are disposed to interpose at least a tip of the external conductor therebetween, wherein at least a peripheral surface of the tip of the external conductor is surrounded by the first wall, the second wall, the base portion and the lid when the lid is in the prone state, wherein the cylindrical main body includes a slit that extends in the height direction of the cylindrical main body, wherein the first and second arm portions protrude from side edges of the slit parallel to the radially outward direction of the insulating main body, wherein the first and second arm portions are in contact with the first and second walls, respectively, so that the protrusion is positioned between the first and second arm portions, wherein the first and second walls include first parts that face at least a part of the insulator that covers the internal conductor, and second parts that face at least a tip of the external conductor, and wherein a separation distance between the first parts is smaller than a separation distance between the second parts.

2. The connector assembly according to claim 1, wherein at least a part of the insulator is not covered with the first and second walls.

3. The connector assembly according to claim 1, wherein a recessed groove which extends toward the insulating main body and in which the internal conductor is arranged is provided in the protrusion.

4. The connector assembly according to claim 1, wherein the first and second walls include a first engaged portion and a second engaged portion, respectively, wherein the first arm portion includes a first engaging portion engageable to the first engaged portion, and wherein the second arm portion includes a second engaging portion engageable to the second engaged portion.

5. The connector assembly according to claim 1, wherein the lid includes a fixing portion that grips the protrusion by being folded around the first arm portion until it reaches a bottom surface of the protrusion when the lid is positioned in the prone state.

6. An electrical connector that is configured to be connectable to a coaxial cable which includes an internal conductor, a cylindrical insulator covering the internal conductor, and a cylindrical external conductor covering the insulator, in which the external conductor, the insulator and the internal conductor are exposed stepwise in that order toward a tip, wherein the electrical connector includes a conductive signal contact conductor to which the internal conductor is configured to be connected;

a conductive ground contact conductor to which the external conductor is configured to be connected; and an insulating housing that insulates the signal contact conductor from the ground contact conductor, wherein the insulating housing includes a cylindrical insulating main body in which the signal contact conductor is held; and a protrusion that protrudes from a peripheral surface of the insulating main body in a radially outward direction of the insulating main body, wherein the ground contact conductor includes a cylindrical main body in which the insulating main body is accommodated, the cylindrical main body including a connecting portion which extends from an upper edge of the cylindrical main body in a height direction of the cylindrical main body;

a lid that extends from the connecting portion so that the posture of the lid is changeable between an upright standing state and a prone state in which the lid approaches the cylindrical main body; and first and second arm portions, and wherein the protrusion includes a base portion on which the insulator and the external conductor are placed, and first and second walls that are erected on the base portion and form a space in which at least a tip of the external conductor is able to be disposed with the base portion, wherein the first wall, the second wall, the base and the lid form a space that is configured to surround at least a peripheral surface of the tip of the external conductor when the lid is in the prone state, wherein the cylindrical main body includes a slit that extends in the height direction of the cylindrical main body, wherein the first and second arm portions protrude from side edges of the slit parallel to the radially outward direction of the insulating main body, wherein the first and second arm portions are in contact with the first and second walls, respectively, so that the protrusion is positioned between the first and second arm portions, wherein the first and second walls include first parts that are formed to face at least a part of the insulator that covers the internal conductor, and second parts that are formed to face at least a tip of the external conductor, and wherein a separation distance between the first parts is smaller than a separation distance between the second parts.

7. The electrical connector according to claim 6, wherein the first and second walls are not provided in a region that faces at least a part of the insulator.

8. The electrical connector according to claim 6, wherein a recessed groove extends toward the insulating main body, the groove being configured to accommodate the internal conductor inside thereof.

9. The electrical connector according to claim 6, wherein the first and second walls include a first engaged portion and a second engaged portion, respectively, wherein the first arm portion includes a first engaging portion engageable to the first engaged portion, and wherein the second arm portion includes a second engaging portion engageable to the second engaged portion.

10. The electrical connector according to claim 6, wherein the lid includes a fixing portion that grips the protrusion by being folded around the first arm portion until it reaches a bottom surface of the protrusion when the lid is positioned in the prone state.

* * * * *